United States Patent [19]

Walker

[11] Patent Number: 5,052,301

[45] Date of Patent: Oct. 1, 1991

[54] ELECTRIC INITIATOR FOR BLASTING CAPS

[76] Inventor: Richard E. Walker, 237 Charleston St., Cadiz, Ohio 43907

[21] Appl. No.: 560,349

[22] Filed: Jul. 30, 1990

[51] Int. Cl.[5] ..... F42B 3/13

[52] U.S. Cl. ..... 102/202.7; 102/202.5

[58] Field of Search ..... 102/202.1, 202.2, 202.5, 102/202.7

[56] References Cited

U.S. PATENT DOCUMENTS

| | | | |
|---|---|---|---|
| 3,264,990 | 8/1966 | Betts | 102/202.7 |
| 3,264,991 | 8/1966 | Betts et al. | 102/202.7 |
| 3,277,824 | 10/1966 | Bankston | 102/202.7 |
| 3,510,732 | 5/1970 | Amans | 317/23.4 |
| 4,267,559 | 5/1981 | Johnson et al. | 357/81 |
| 4,412,234 | 10/1983 | Matsuda | 357/17 |
| 4,447,825 | 5/1984 | Oana | 357/71 |
| 4,840,122 | 6/1989 | Nerheim | 102/202.7 |
| 4,907,044 | 3/1990 | Schellhorn | 357/17 |
| 4,920,404 | 4/1990 | Shrimali | 357/72 |
| 4,938,137 | 7/1990 | Guay | 102/202.7 |

OTHER PUBLICATIONS

Paper 11 entitled Exploading Foil Initiators—an Overview by: Olin K. McDaniel, III.

*Primary Examiner*—Charles T. Jordan

*Attorney, Agent, or Firm*—Body, Vickers & Daniels

[57] ABSTRACT

In an electric detonator or blasting cap of the type including a base charge of high explosive material, an initiator means or initiator for creating an abrupt eruption in response to application of a selected voltage across the igniter and means for detonating the base charge upon creation of the abrupt eruption of the initiator, there is provided an improvement comprising forming the initiator as a junction of energetic material, such as a PN junction of an LED chip, encapsulated in a plastic or glass confinement housing. The housing has a directional controlling partition means facing in a selected direction. This partition has an effective spacing from the junction substantially less than the remainder of the confinement housing whereby application of a voltage pulse of over about 500 volts causes the junction to form an electric arc to create a plasma by a confined, high temperature, high pressure exothermic reaction. The effective spacing of the aforementioned partition at the junction is thick enough to confine the exothermic reaction until creation of the plastic and thin enough to allow the plasma to rupture the controlled partition and penetrate through the partition a given distance in the selected direction. The base charge is located in the selected direction and spaced from the partition a distance less than the given distance of plasma penetration whereby the plasma impacts against the base charge, thus, detonating the base charge.

63 Claims, 6 Drawing Sheets

FIG. 4
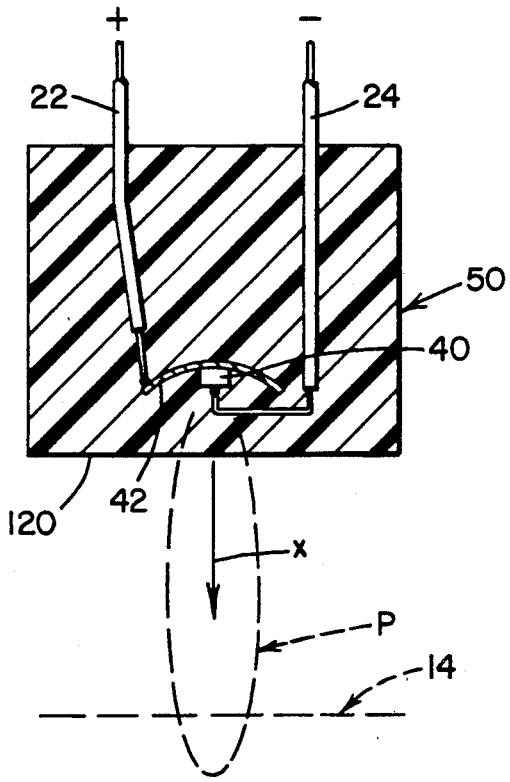
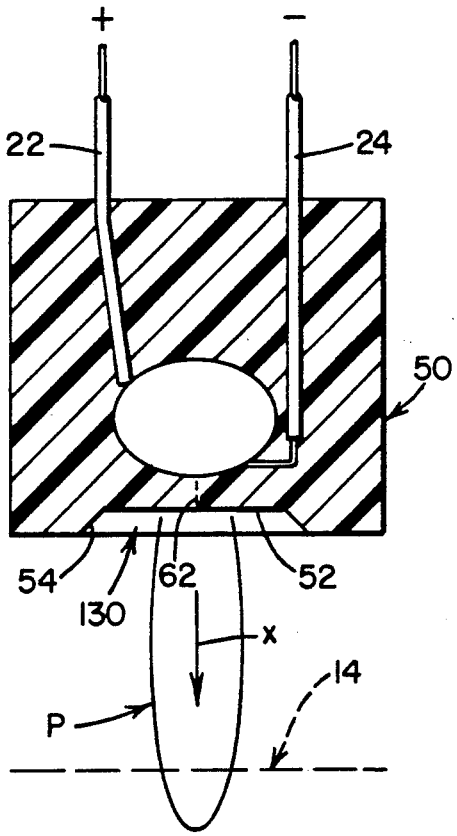
FIG. 5
FIG. 6
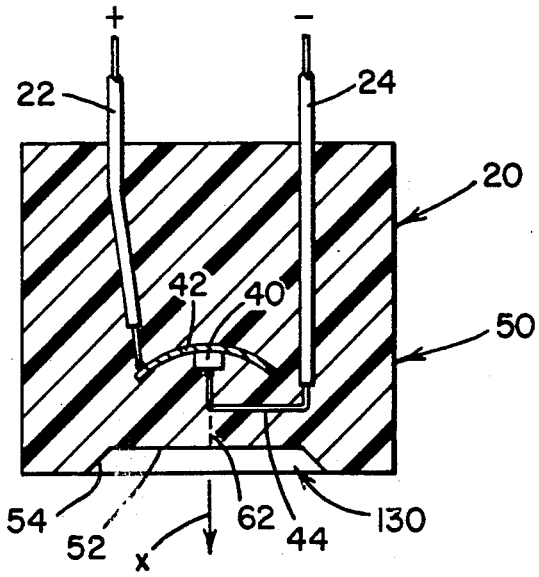

FIG. 7
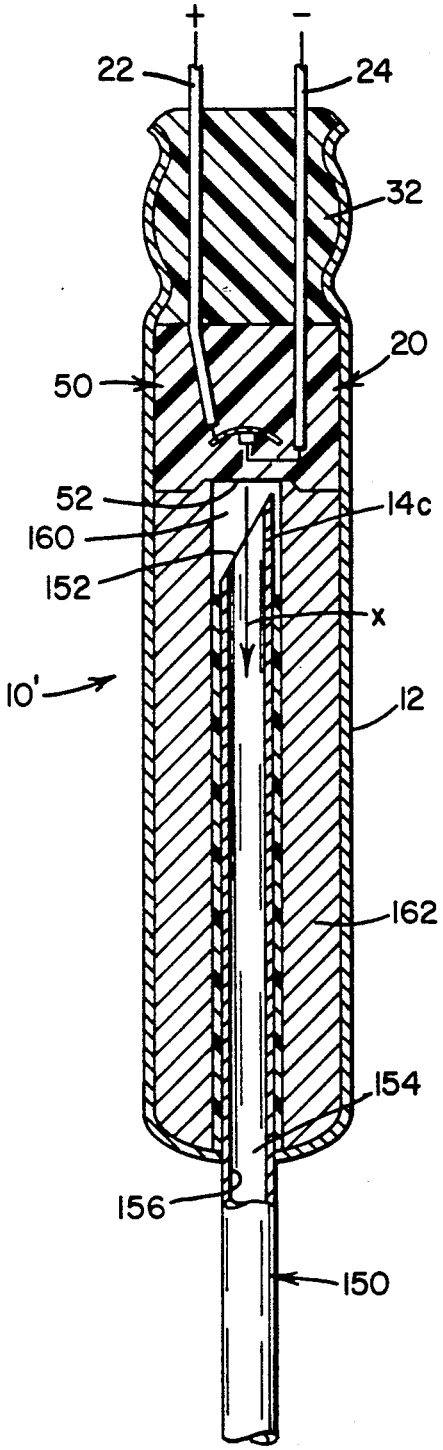
FIG. 8
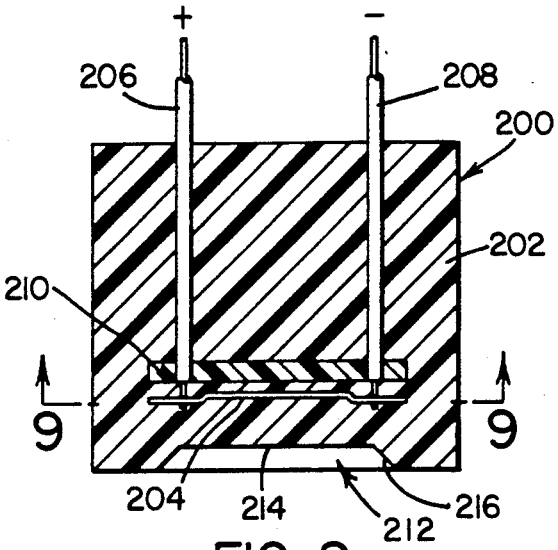
FIG. 9
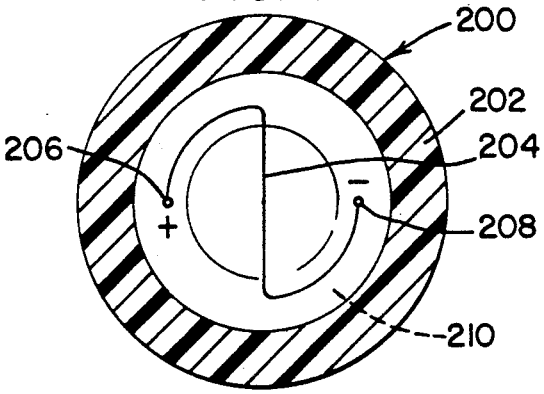
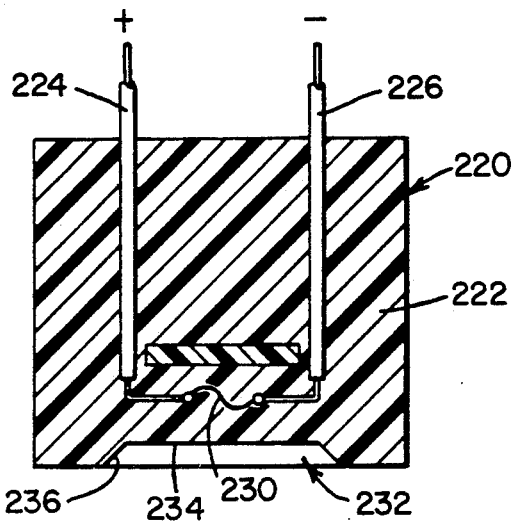
FIG. 10

FIG. 13
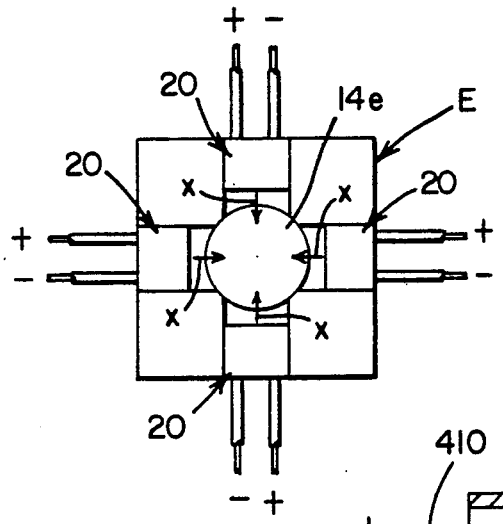
FIG. 14
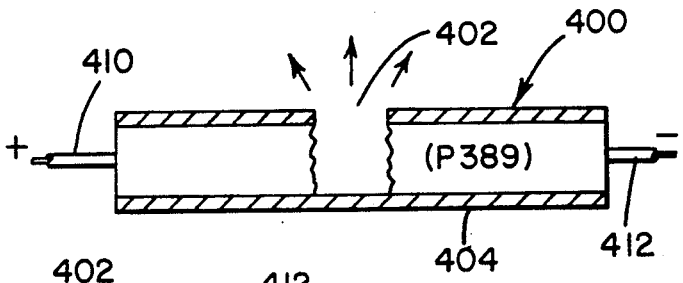
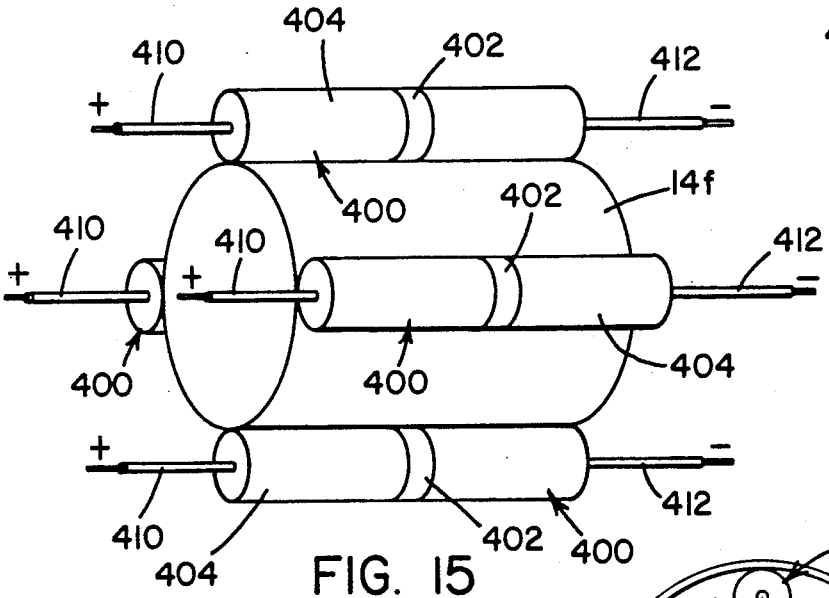
FIG. 15
FIG. 16
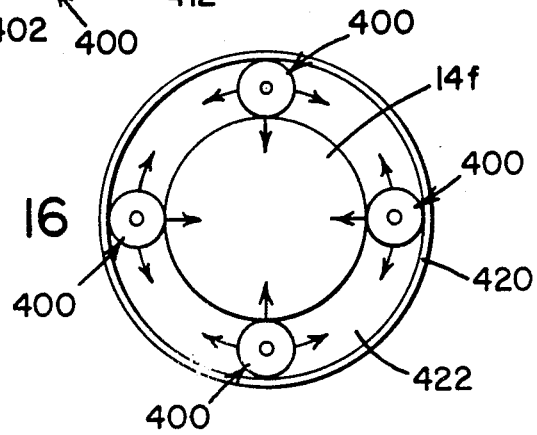

FIG. 17
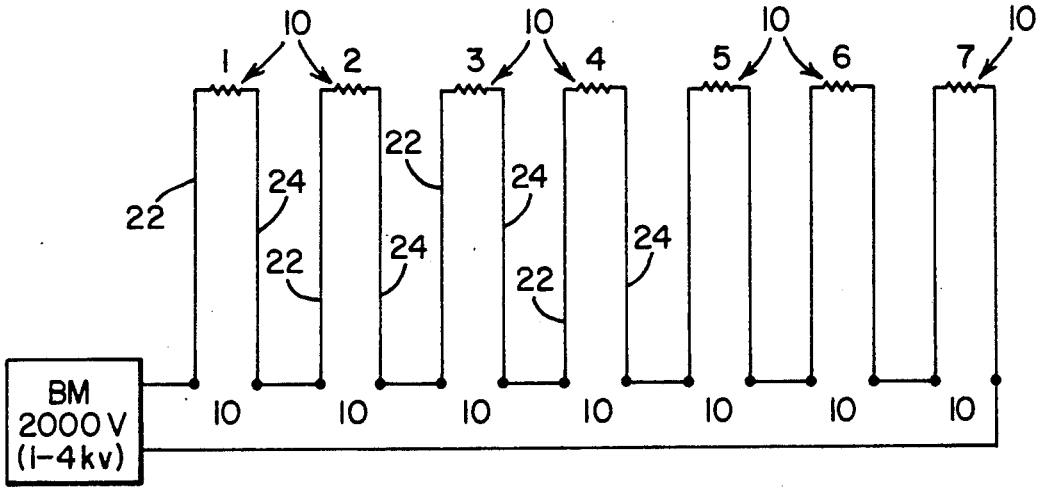
FIG. 18
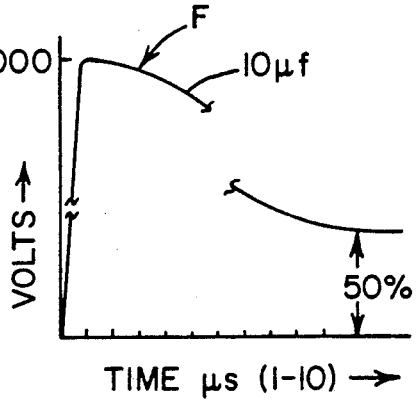
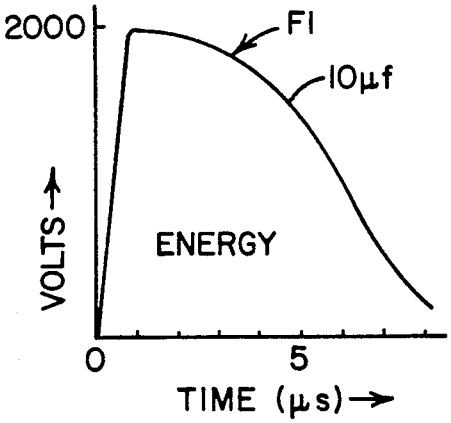
FIG. 18A
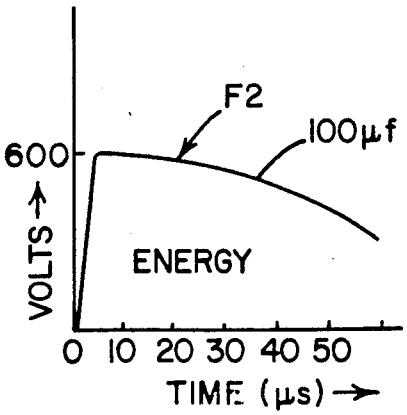
FIG. 18B

ELECTRIC INITIATOR FOR BLASTING CAPS

DISCLOSURE

This invention relates to the art of electric blasting caps and more particularly to an improved electric initiator for a blasting cap.

BACKGROUND OF INVENTION

When employing explosives for the purpose of excavation, strip mining, and related earth moving activities, it is common practice to place a number of charges of relatively inexpensive explosive material throughout the area to be affected and use primers for the purposes of exploding all of the various charges. In this way, relatively inexpensive explosive material can be employed for the purposes of effecting the desired heave and movement of the affected area. The primers are high explosive material; however, they are relatively insensitive to normal detonation procedures and require a detonating cap to be initiated. Detonation of the primers initiates the low cost explosive charges. These primers can be initiated by non-electric detonating cord strung throughout the affected area; however, one of the more easily controlled system involved the use of electric blasting caps for the primers. These electric blasting caps are normally cylindrical metal containers or cartridges having a lower portion, or base charge, of high explosive, such as PETN or lead azide. An upper portion of the cartridge includes initiator leads extending from the cartridge. A voltage across the leads causes an abrupt event or eruption of the initiator. In the past, this abrupt event has involved an $I^2R$ heating of a bridgewire that is directly associated with a sensitive explosive sometimes referred to as a "match head" composition. When this composition or explosive is initiated, the PETN and/or lead azide of the base charge is detonated. This then initiates the primer into which the blasting cap is inserted for the purpose of subsequently initiating the less expensive, bulk type explosive material of the individual charges spaced throughout the affected field. To obtain a delay, a delay explosive is placed between the match head composition and the base charge. This intermediate charge would accurately control the time from the abrupt eruption of the initiator to the explosion of the high explosive base charge. These electric blasting caps are used by the millions throughout the world for the purpose of stringing explosive fields for moving earth in the desired, controlled fashion. Since initiation of the blasting cap is by $I^2R$ through a bridgewire, a low voltage signal can be employed. This makes the blasting caps susceptible to electronic counter measures (ECM), radio frequency interference (RFI), electromagnetic interference (EMI) and electromagnetic pulses (EMP). Since the low voltages can initiate these blasting caps, stray electric energy, such as lightning, and electrical equipment can induce detonating voltage at the cap wires. This prevented the fields from being strung with caps for a long period of time before detonation.

Since prior blasting caps included a portion of high explosive material, they were classified in a manner which limited their mode of transportation. Also, prior electric blasting caps were somewhat sensitive to impact detonation. These existing caps also were not necessarily nuclear hard due to sensitivity to electromagnetic pulses which could induce a detonation voltage. Further, prior blasting caps sometimes were not insensitive to radar signals. All of these limitations to the use of standard electric blasting caps have been known for some time and had to be taken into consideration in the handling, transportation and use of these blasting caps throughout the world. There has been a tremendous need for an electric blasting cap which is insensitive to the many existing fields and handling vicissitudes associated with the high explosive industry. For this reason, many situations have dictated the abandonment of electric blasting caps for non electric systems. This reduces the control and efficiency of the blasting operation and was a major factor in the limitation of the commercial success of blasting caps.

Many years ago, a detonator known as a "slapper" was suggested using a flat aluminum sheet to drive another plastic sheet known as a "flyer." The theoretical concept was not used in electric blasting caps and did not find use in the explosive art.

INCORPORATION BY REFERENCE

The present invention relates to the use of a standard LED device as the initiator of an electric blasting cap. Either an epoxy or glass packaged Panasonic P380 (LN264CT) or a radial Panasonic No. P389 (LN2G) are employed. These are standard LEDs available to the public. The following patents relating generally to LED chips of the type including PN junctions are incorporated by reference for purposes of background information. Matsuda U.S. Pat. No. 4,412,234; Oama U.S. Pat. No. 4,447,825; and, Shrimali U.S. Pat. No. 4,920,404. A disclosure of the packaging concept which is standard practice in the industry and used in the devices employed in the present invention is generally illustrated in Schellhorn U.S. Pat. No. 4,907,044 for an optical emission device which employs an LED chip for the creation of the illumination. The LED chip can be packaged in plastic or glass as long as the internal elements are "potted" by the encapsulating material and it has a hardness or imperviousness of glass.

THE INVENTION

The present invention provides an improved electric initiator or initiator system for an electric blasting cap which is not susceptible to environmental fields, is not impact sensitive, can be transported and used safely in all normal ambient conditions and which is inexpensive to produce and positive in operation.

In accordance with the invention, there is provided an improvement in an electric detonator or blasting cap of the type including a base charge of high explosive material, such as lead azide or PETN and an initiator means, or initiator, for creating an abrupt eruption in response to application of selected voltage across the initiator and means for detonating the high explosive base charge upon creation of the abrupt eruption of the initiator. The improvement in this type of electric blasting cap is in the area of the initiator or initiating means. In accordance with the invention, the initiator means includes a junction of energetic material. This means a material which, when subjected to a high voltage pulse having a substantial resident time due to capacitor discharge, will create an electric arc. The electric energy of the arc is sustained as the arc is retained in the encapsulation of the confinement or containment housing. In accordance with the preferred embodiment of the invention, the energetic material is a PN junction or LED chip in a standard epoxy or glass packaged LED device of the type sold by Panasonic under the designation of P380 (LN264CP). Other energetic materials, both metal and semi-conducting, are available wherein a high voltage, capacitance electrical pulse will create an arc in the junction, which arc can be sustained under confinement until it is converted into a plasma by a confinement such as is accomplished in the clear epoxy or glass package of a standard LED device. The initiator means includes the junction of energetic material as defined above. This junction is encapsulated in a plastic or glass confinement housing, such as a standard epoxy package around the LED chip in a standard LED device. In accordance with the invention, this confinement housing around the junction of energetic material has a directional controlling partition means facing in a selected direction and having an effective spacing from the junction which spacing is substantially less than the remainder of the partition thickness around the junction. Thus, one area of the plastic or glass encapsulating, confinement housing has a reduced thickness. In this manner, when a voltage pulse, which has a high initial voltage and is sustained by capacitance, is applied across the junction, the junction is converted into an electric arc. This arc is confined until it creates a plasma by a confined, high temperature, high pressure, exothermic reaction. The voltage pulse, in accordance with the invention, is created by a blasting machine operated by an SCR for voltages up to about 1000 volts and by trigger tube circuit for higher voltages. The pulse has a voltage in excess of about 500 volts. The pulse is sustained over a period of time by capacitance. This arc sustaining time is generally less than about 10–30 microseconds. The voltage pulse immediately shifts to the high initial voltage and is then sustained by the capacitance of the machine for at least about 5–10 microseconds before the voltage decreases to approximately 50% of its initial value. Thus, the electric arc energy created by the initial current caused to flow by the high initial voltage of the voltage pulse is sustained to sustain the arc much like an electric arc welding device. Since this arc is confined by the hard plastic or glass housing, the temperature within the electric arc increases. The pressure also increases through an exothermic reaction to create a plasma which ultimately ruptures the directional controlling partition. To assure this rupture action, the effective spacing of the partition or thickness of the partition at the junction is thick enough to confine the exothermic reaction until creation of the plasma and thin enough to allow the plasma to rupture at the controlled partition. The plasma created by the sustained, confined electric arc energy will penetrate through the partition a given distance in the selected direction determined by the orientation of the controlled partition. This plasma column is driven through the containment partition using a shaped charge phenomenon to create a high impact, high temperature, high energy column extending from the sustained exothermic reaction at the energetic metal junction.

In accordance with the invention, the base charge is fixed within the blasting caps in the aforementioned selected direction and is spaced from the ruptured partition a distance less than the given distance that the exothermic reaction driven plasma will travel. Thus, the high impact, high energy, high pressure vaporized gases and/or vaporized metals within the column from the arc energy junction impact upon the high explosive base charge and detonates either the lead azide or the PETN. Lead azide is relatively sensitive and is positioned at a given standoff to be directly impacted and detonated by the plasma column from the partition. Lead azide is impact responsive. PETN is a less sensitive high explosive. When using only PETN a longer voltage pulse may be used to sustain the electric arc for a longer period of time so that pressure in the standoff volume or cavity will increase to thus cause an increase in temperature and pressure. Detonation of the relatively less sensitive PETN is by pressure and heat as well as Nano and micro speed impingement of the plasma column, i.e. hypervelocity impact of the PETN.

In accordance with the invention, the PN junction is activated by a high energy voltage pulse which creates an electric arc and sustains the electric arc by feeding electric energy into the arc from a blasting machine. The arc or plasma is sustained with continuing infusion of high energy by maintaining the voltage high and the capacitance relatively high. This continued energy technique can be accomplished with a blasting machine having approximately 1–4 K volts. This machine retains approximately 50% of the initial voltage through the arc for 5–10 microseconds. The capacitance is increased to 10–20 microfarads so that the plasma created by the sustained voltage pulse will give high speed impact energy when the plasma engages the spaced base charge of the electric blasting cap. Thus, the invention anticipates a sustained plasma. In addition, the partition or other arrangement is provided to focus or direct the plasma. This can be accomplished by a standard electrode in an LED package, a fixed back plate added to the package and/or a shaped cavity within the directional controlling partition. This shaped cavity can have the desired shape to cause a well known shaped charge jet of material flowing through the partition toward the base charge.

By using this invention, the base charge can be a standard shock tube or PETN, lead azide, etc. In accordance with another aspect of the invention, the base charge is covered with a metal partition, such as a copper layer, through which the plasma column will penetrate to detonate the base charge. Thus, two separate and distinct safety barriers are provided. The first, or primary, barrier is the encapsulating housing. This housing can not rupture unless the plasma is created. The plasma can not be created without the use of a voltage pulse including an initial high voltage, which voltage is sustained for a prolonged period of time. The plasma is created by continuing to feed electrical energy into the initially created arc so that the electric arc energy in the confined housing starts the build up of pressure and temperature until a plasma is created. Upon creation of the plasma, the partition having a reduced size is immediately ruptured so that the plasma issues in a straight line in a selected direction controlled by the partition configuration and orientation. This partition directs the plasma toward the second safety partition covering the explosive base charge. These two barriers can not be violated by exposure of the electrodes of the blasting cap to stray electromagnetic signals or fields.

In accordance with the invention, the standard LED device including the PN junction or chip embedded and encapsulated in clear epoxy or glass is modified by grinding off the top surface of the device until there is between 1/32–3/32 of an inch thickness from the junction to the closest surface of the LED package. This thin wall defines the rupture point of the confinement housing. In practice, this spacing is approximately 1/16 of an inch. These LED devices have a generally concaved anode surface which supports the energetic material chip that creates the emitted light. A gold wire is used as the cathode. This gold wire carries the electric voltage pulse to initiate the electric arc when a voltage pulse, anticipated by the present invention, is applied to the LED package. The gold evaporates when the junction creates the arc. Continued energy applied to the electric arc causes not only a plasma gas, but also a plasma including the vaporized gold. As is well known, when gold vaporizes, it expands approximately 30,000 times. This gold vapor, together with the gas plasma created by the sustained arc in a confined area, increases the impact and energy level of the plasma as it engages the secondary safety barrier over the base charge. If the partition on the LED package is less than about 1/32, then the plasma may not be created by the arc since there may be a cooling effect and/or migration of gas through the thin partition. It has been found that the direction controlling partition caused by grinding away the face or top of the LED package must have a thickness to allow confinement of the electric arc until the energy in the confined arc causes a plasma, which plasma then erupts through the intentionally reduced area of the LED package.

It is conceivable to employ a standard bridgewire with a back plate encapsulated in clear hard plastic or glass and having the reduced partition provided at the bridgewire. The wire must be energetic material in that it causes an electric arc to first be created and then a plasma as the arc is sustained over 5–30 microseconds. The back plate is a force reactive plate such as the anode of a standard LED device. The back plate causes the plasma created within the junction to erupt forward through the partition and toward the high explosive base charge within the electric blasting cap.

In the invention, the confinement of the electric arc must take place for the purpose of creating the plasma as arc energy is continued to increase in the containment of the glass-like encapsulating housing. The resulting plasma erupts through the housing partition and causes detonation of the base charge. Of course, the lead azide could have either a copper layer over the top or could be encapsulated in some fashion to prevent detonation except by the plasma being driven through the second barrier over the base charge.

In accordance with another aspect of the invention, the energetic material could be metal such as certain metals used as a bridgewire for the purpose of creating an electric arc that then is converted into the plasma by confinement in a glass or hard plastic housing. The plasma erupts the housing and causes the ultimate detonation of the blasting cap.

The primary initiator system of the invention is the creation of a plasma by first creating an electric arc and feeding the electric arc with electric energy while the arc is contained in a confined space so that the energy introduced into the electric arc is not dissipated by radiation, conduction or convection. Creation of the electric arc within a plastic or glass confinement housing prevents such heat dissipation and allows the heat, pressure and energy of the arc to build up within the confinement chamber or housing until it erupts the housing. The housing is modified so the eruption takes place in a selected direction to cause a directional aspect to the plasma. This directional aspect is enhanced by a shaped charge recess in the housing partition. The partition through which the eruption takes place is thin; however, it has a concave configuration to cause a shaped charge action or the Monroe-like effect. The encapsulated material, i.e. epoxy or glass, is adhered directly to the PN junction or chip as well as to the lead wires of the LED device so that the exothermic reaction is within a highly insulated controlled chamber. This containment action, together with the provision of a directional control partition creates the directional plasma. The high explosive base charge is spaced from the partition. This is a standoff so that the jet caused by the plasma and shaped charge effect has high impact energy when it engages the spaced base charge. If metal, such as a liner, is included in this plasma the fluid is inviscid which enhances the impact characteristics of the plasma when it engages the spaced base charge. This spaced area of volume through which the plasma issues is a secondary reaction chamber. This hollow chamber acts in a Diesel effect to allow increased pressure to thus cause the gas in the standoff chamber to have an increased pressure. This pressure acts on the high explosive base charge. As explained earlier, this standoff secondary reaction allows use of a more insensitive high explosive as the base charge in the blasting cap.

To assure that the jet or plasma from the arc energy area flows in a precise direction, the partition may include a rupture point such as an etched line. Thus, the high energy plasma which is focused by the Monroe effect, a focusing device, or both, is directed and focused in a straight line intersecting the high explosive base charge.

Although so far described as a standard LED package, the invention can employ a linear LED such as a Panasonic P389 (LN2G). That type of device also includes a PN junction between two linear electrodes. When the plasma is created in accordance with the invention, the direction is radially outwardly from the linear LED device. To control or focus the high energy plasma, one portion of the circumference around the LED is reduced in thickness. Thus, the plasma issues directly through that portion of the encapsulation material which can be aimed in any direction for the purposes of igniting a spaced high explosive. The detonation action, at the high explosive, is primarily an impact action and not necessarily a temperature reaction. The reaction occurring in the space between the initiator and the base charge has an increased effect as the time and energy directed into the electric arc is increased. This second detonation feature can be more important when several initiators direct individual plasma columns into a compartment provided above the explosive base charge. As all of the plasma columns are directed into this compartment or chamber, the temperature and pressure in the chamber increases drastically so that the actual explosion of the base charge may be enhanced by the secondary detonation action. The shape of the voltage pulse can be changed to control the arc and plasma caused by the exothermic reaction. By using high initial voltage and low sustaining capacitance, the pulse will provide a rapid release of energy from the capacitors in the blasting machines. This will give an abrupt in rush of arc energy into the confined area. This action is an abrupt voltage pulse. A higher capacitive reactance within the blasting machine will prolong the length of the high voltage portion of the voltage pulse. A reduced initial voltage will decrease the amount of initial energy causing the electric arc to be formed. Consequently, the initial voltage and the amount of voltage sustaining capacitance within the blasting machine are selected for the purpose of controlling the initiation of the electric arc and the duration of the time during which energy is being fed into the arc for the purposes of creating the plasma. The temperature pressure, kinetic energy and other factors within the confined area are affected by the initial voltage and the duration of current introduced by the voltage pulse. The initial voltage must be sufficient to cause an arc in the energetic material. It has been found that this requires at least about 600 volts and preferably in the range of 1–4 K volts. The capacitance should be sufficient to cause the voltage to be sustained above 50% for at least about 10–20 microseconds. In this manner, the arc is created and sustained for a prolonged period of time sufficient to allow creation of the plasma within the confined area. The electrical parameters of the electric voltage pulse used to create the exothermic reaction for converting the electric arc energy into a plasma for eruption through the confinement housing is controlled to produce the desired energy for the number of caps to be detonated. The capacitance is preferably in the general range of less than 0.1 microfarads to a preferred range of 10–20 microfarads. This voltage pulse will sustain the plasma even after the partition rupture occurs. As the initial voltage of the pulse increases, the time of the pulse decreases assuming the capacitance remains the same. As the capacitance increases, the time of the pulse also increases. Thus, the parameters of the electric voltage pulse are controlled to determine the precise nature of the plasma; however, the invention involves merely the formation of the plasma which erupts through the containment housing and engages the high explosive base charge of a blasting cap. The high energy builds up pressure which is released through the housing as the exothermic process continues. Thus, the confinement of the arc is essential to the creation of the necessary directional plasma.

Various energetic materials can be used such as the typical III, V group compounds. Aluminum gallium arsenide is somewhat common. Gallium arsenide is often used as a PN junction, which is the preferred energetic material of the invention. The exothermic reaction of the energetic materials creates a chemical change to release heat energy in the confinement housing. This causes the electric arc explosion through the creation of a classic plasma by directing energy into the electric arc. This plasma is focused or directed mechanically. By use of metal vapors, such as gold in a connector wire of a standard LED device, metal vapor is entrapped and assists in the spaced charge action of the exploding plasma. The plasma has tremendous speed, high thermal content and extremely high kinetic energy when it enters the standoff volume or cavity above the base charge of the blasting cap. The focusing of this plasma by either the shaped charge effect or by a lens concept, concentrates the plasma energy on the high explosive base charge.

A standard low voltage pulse to the junction of energetic material would merely cause a fuse action of low energy which would not break the confinement chamber. The PN junction would merely burn out and no high energy would be created within the confinement housing to cause an electric arc and then a sustained arc for causing a plasma for erupting into the standoff volume or cavity. Thus, the PN junction, in accordance with the present invention, is over energized to detonate by action of accumulated arc energy. This electric arc energy is held within the confinement housing to increase its temperature and pressure. Then the plasma is directed and/or focused toward the secondary barrier over the base charge. The electric arc exceeds 6,000° C. initially and has higher temperatures as it is confined before forming the plasma.

The primary object of the present invention is the provision of an improved initiator for an electric blasting cap, which improved initiator positively detonates the blasting cap, but is not activated by stray fields, from the impact or by other normally encountered handling conditions.

Another object of the present invention is the provision of an improved initiator for an electric blasting cap, as defined above, which improved initiator creates an electric arc within a confined space and feeds electrical energy into this electric arc until a plasma is created and erupts through the wall of the confinement housing and initiates the blasting cap.

Still a further object of the present invention is the provision of an improved initiator for an electric blasting cap, as defined above, which improved initiator incorporates two safety barriers, one of which surrounds the initiator and the other of which is over the spaced base charge.

Still a further object of the present invention is the provision of an improved initiator for an electric blasting cap, which improved initiator is relatively inexpensive to produce, positive in action, and not subjected to inadvertent detonations.

These and other objects and advantages will become apparent from the following description taken together with the accompanying drawings in which:

BRIEF DESCRIPTION OF THE DRAWINGS

FIGS. 4–6 are schematic enlarged cross-sectional views illustrating further modifications of the preferred embodiment of the present invention;

FIG. 7 is a cross sectional view showing an electric blasting cap constructed in accordance with the present invention using a shock tube as the "base charge";

FIG. 8 is an enlarged cross sectional view of an initiator employing a bridgewire;

FIG. 9 is a cross sectional view taken generally along line 9–9 of FIG. 8;

FIG. 10 is an enlarged cross sectional view of an initiator employing a wire fuse formed from energetic metal as the junction of the initiator;

FIG. 13 is a schematic plan view illustrating the use of four separate and distinct initiators to detonate a single explosive charge;

FIGS. 14–16 are a side elevational view, pictorial view and an end view, respectively, showing a radial LED device used in the explosion networks shown in pictorial view FIG. 15 and cross-sectional view FIG. 16;

FIG. 17 is an electrical diagram showing the method of igniting a series of blasting caps employing the preferred embodiment of the present invention;

FIG. 18 is a graph illustrating the electrical pulse employed in the preferred embodiment of the present invention; and, FIGS. 18A, 18B are graphs illustrating electrical characteristics of the pulse employed in accordance with the present invention.

PREFERRED EMBODIMENTS

Figure 1:
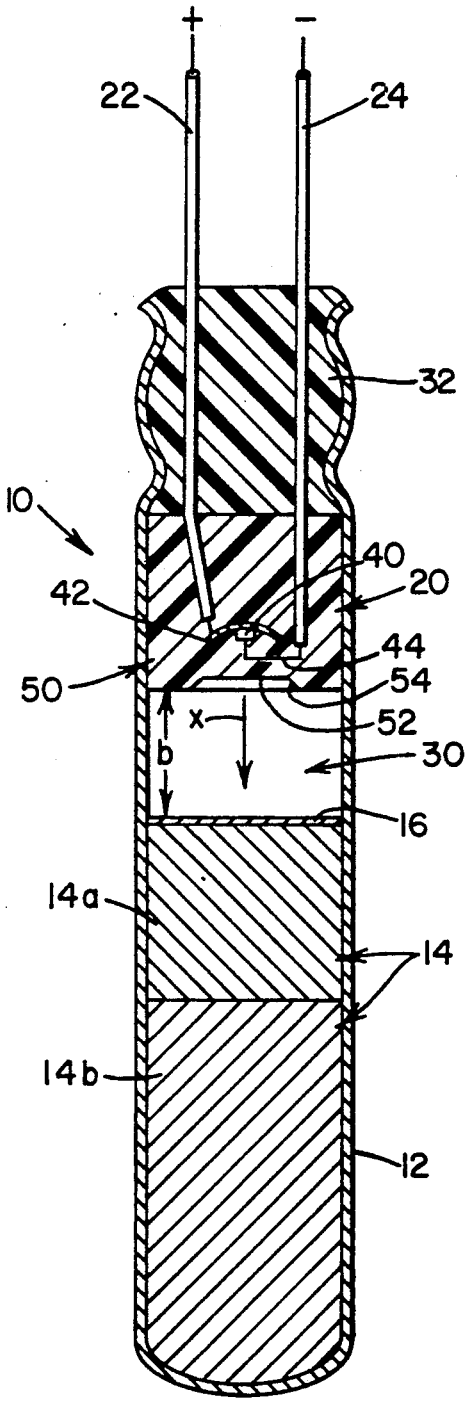
FIG. 1 is a cross sectional view of a blasting cap employing a preferred embodiment of the present invention.
Figure 2:
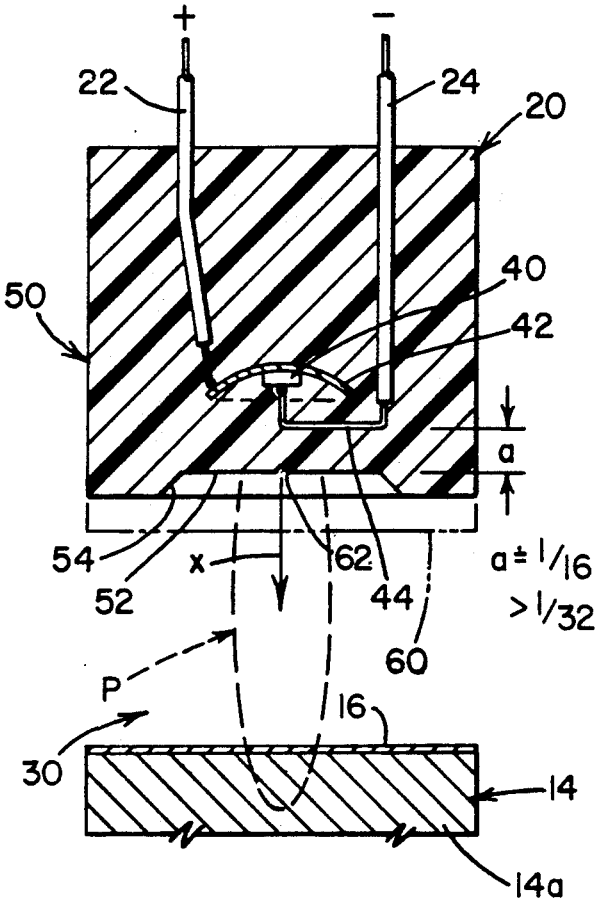
FIG. 2 is an enlarged partial view of the initiator illustrated in FIG. 1.

Referring now to the drawings wherein the showings are for the purpose of illustrating preferred embodiments of the invention only and not for the purpose of limiting same, FIGS. 1 and 2 show a blasting cap 10 having a tubular, drawn metal cartridge or shell 12 with a lower base charge 14 illustrated as two components, lead azide 14*a* and PETN 14*b*. The base charge is defined as the charge which accepts the initiation and cause detonation of a primer or other explosive associated with blasting cap 10. The lead azide is spark sensitive, whereas PETN is more pressure and heat sensitive. As a secondary safety barrier there is provided a barrier 16 of copper over the lead azide 14*a* of base charge 14. The lead azide could be encapsulated with metal or other material to form the second barrier 16. Barrier 16 has a standoff b from the lower end of initiator 20 which initiator is constructed in accordance with the present invention. In the preferred embodiment, a Panasonic P380 (LN264CP) LED device is modified to be employed in practicing in the invention. The initiator includes wire leads 22, 24 across which a voltage signal or pulse is applied for causing the abrupt eruption of initiator 20 to detonate blasting cap 10. Standoff distance b defines a standoff volume or cavity 30 which is a secondary initiating chamber. Gas in this cavity increases in pressure and, thus, temperature to assist in the detonation of base charge 14. Around the neck of cartridge 12 there is provided appropriate crimped seal 32. The Panasonic LED device includes a PN junction 40 formed from energetic material such as gallium arsenide or aluminum gallium arsenide, which energetic material has been found to create the ignition system of the present invention. Junction 40 which is the LED chip or PN junction is supported within the concave anode 42 having a lens function to focus the subsequently formed plasma in direction x. This anode forms a pressure resisting, or force reactive, back plate for initiator 20. Cathode 44 is a fine gold conductor from lead 24 and is connected to one electrode or one terminal side of PN junction, or chip, 40. The other electrode or terminal side of the junction is adhered to the concave surface of anode 42. This assembly of a PN junction, anode and cathode is encapsulated in a clear epoxy plastic or glass 50 forming an encapsulation confinement housing of initiator 20. The housing is the body of the LED device used in the preferred embodiment of the invention. A direction controlling partition means 52 is a flat wall having an outer surface spaced from chip 40 a distance a, which distance is selected to be thick enough to confine an electric arc at junction 40 while the electric arc is receiving energy from leads 22, 24 and until the arc energy has built up sufficiently for the purpose of creating a plasma P. This spacing a is thin enough to allow this plasma to rupture partition or wall 52 and allow the plasma to travel in the selected direction x toward barrier 16 of base charge 14, as best shown in FIG. 2. The partition 52 includes a recess that acts as a lens to focus plasma P. Back plate 42 can help in the focusing and directing function. These features control the direction of plasma P to coincide with selected direction x. The shape of partition 52 is provided by grinding off the top portion 60 of the Panasonic LED packaged unit. In practice this top portion 60 is removed by grinding or milling to provide wall or partition 52 with a thickness of about 1/32–3/32 of an inch. Preferably, this thickness is about 1/16; however, the thickness should be over about 1/32. By using this thickness, there is sufficient strength and wall integrity in partition 52 to guard against quenching or dissipation of the heat energy created at junction 40 when a high voltage pulse is applied across leads 22, 24 to create an electric arc. As the pulse remains to feed energy into the arc, the arc is confined until the energy within the electric arc and its confinement space is sufficient to create a plasma. The conversion to plasma P causes an immediate and abrupt explosion through partition or wall 52. Plasma P enters cavity 30 and impinges upon barrier 16 of base charge 14. To assist in this abrupt rupture of wall 52, an etched line 62 is provided across the flat circular surface of the partition or wall. To create a shaped charged feature, wall 52 is surrounded by conical periphery 54. This gives a direction to the plasma. Thus, plasma P is directed into chamber or cavity 30 and against the base charge as a shaped charge jet. The standoff between wall 52 and barrier 16 or charge 14 may change according to the initiator 20 used.

The polarity can be reversed. As shown the PN junction will initiate first causing the plasma flow, initial energy and speed flow. This will be followed by a burst of the gold wire adding vaporized gold to the plasma. Gold is a heavy metal that adds more impact effect than lighter metal, such as aluminum.

A high voltage pulse F as best illustrated in FIG. 18 is applied across leads 22, 24 when the blasting cap is to be detonated. This high voltage immediately causes an electric arc at junction 40. The arc is sustained by retaining the voltage across the junction by the capacitance from a capacitor discharge type blasting machine circuit. This high voltage is retained for at least about 10 microseconds at a level of at least 50% of the initial voltage. Thus, the capacitance is high enough to retain this high voltage. Of course, high voltage causes high current flow which introduces energy into the electric arc at junction 40. This energy continues to build up the pressure, temperature in a exothermic reaction within the confinement housing 50. This exothermic reaction of the sustained arc increases the arc energy until a plasma is created. This plasma drastically increases the pressure and temperature at junction 40 to vaporize gold lead 44 and rupture wall or partition 52 allowing the plasma P to immediately fire through cavity 30 into base charge 14. The impact causes the base charge to detonate. If there is an insensitive high explosive, possibly the PETN, the Diesel action in cavity 30 causes an immediate drastic temperature increase as the pressure and temperature of this cavity increases. This creates a secondary detonating reaction for less sensitive high explosives. In this instance, the pulse F may be increased in duration to continue to feed energy into plasma P for the secondary firing or detonating procedure. In practice, the primary detonating system is creation of the plasma P. The secondary reaction is the Dieseling action in compartment or cavity 30. As can be seen, only by a precisely controlled, known high voltage sustained pulse F across leads 22, 24 can the initiator 20 be detonated. This provides a safety barrier at the confinement housing 50 and at copper layer or barrier 16.

Figure 3:
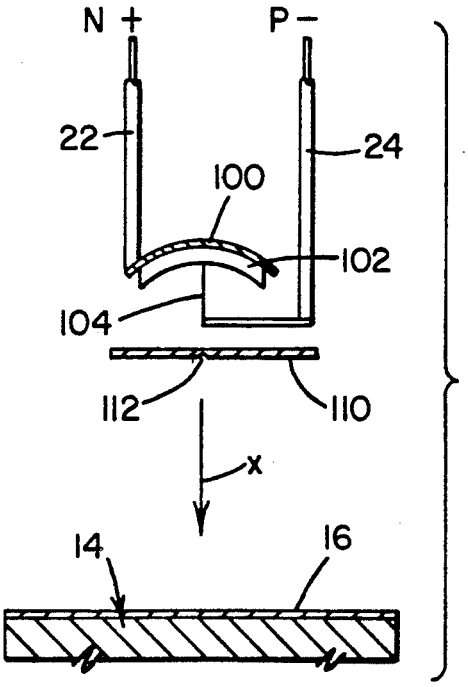
FIG. 3 is a schematic layout view, similar to FIG. 2, illustrating certain modifications in the preferred embodiment of the invention.

Referring now to FIG. 3, a modification of the preferred embodiment is illustrated. Lead 22 is directed to an anode 100 onto which is applied a doped carrier, as a PN junction of energetic material. This junction is the same type of junction as used in an LED chip. Junction 102, however, is conical in shape to be a shaped charge. This shape creates, at the junction, itself a Monroe effect. Cathode 104 is a gold lead as previously described. The gold is vaporized upon formation of an arc when a high voltage pulse F is applied across junction 102. All of these elements (100,102,104) are encapsulated within a clear plastic or glass in the preferred form of a clear, hard epoxy as housing 50. A metal liner 110 is coated upon wall 52 for providing a liner effect to be used in the shaped charge action. This liner provides metal to increase the velocity and impetus of plasma P as it erupts from the arc energy created at junction 102. Again, an etch line 112 controls exactly the fracture or rupture point of the thin partition 52 the location and orientation of which controls the selected direction in which the subsequently created plasma will travel toward barrier 16 and base charge 14. This particular embodiment of the invention illustrates a larger junction 102 containing more material than chip 40 in the preferred embodiment of the invention. Also the formation of junction 102 into a shaped charge configuration increases the energy of the jet or plasma. The shape of junction 102 is conical. Thus, plasma P is directed along axis x. To provide additional vaporized metal for the jet or plasma caused by the shaped charge, liner 110 is provided. This additional metal is vaporized with the gold lead or cathode 104 for making a inviscid fluid flow.

Referring now to FIGS. 4–6, these figures are presented for the purposes of explaining two separate concepts for controlling the direction of plasma P created after the combined arc energy has caused tremendous increases in temperature and pressures. Confinement housing 50 prevents dissipation of heat or the ingress of contaminants so the arc will progress into a plasma. In FIG. 4, the direction creating partition is flat surface 120 ground from the top of a standard LED unit to reduce the thickness or spacing of surface 120 from PN junction 40. When plasma P is created by the increased pressure and temperature through the sustained exothermic reaction of the electric arc, it will rupture at the position of least resistance. This is orthogonal to wall or surface 120. Thus, the wall itself is directional in nature. By providing a conical periphery 54 around partition 52 as illustrated in FIG. 5, the flat surface of the partition is circular and causes plasma to move in direction x. This movement is refined and concentrated in a collimated manner by the periphery wall 54 forming a shaped charge surface. In FIG. 4, plasma P is focused by the concave nature of anode 42. In FIG. 5, the collimation or concentration of the plasma column is by the shape of the recess 130 formed by partition 52 and periphery 54. In both instances, the plasma column is focused and concentrated along selected direction or axis x. In the preferred embodiment of the present invention as illustrated in FIG. 6, both the focusing action of the rear concave anode 40 and the shaped recess 130 are provided. This concentrates the energy within a narrow column flowing directly along axis x for concentrating the energy and impact momentum in this narrow column. Of course, either the focusing action or the shaped charge configuration could be employed with the present invention. The preferred embodiment as shown in FIG. 1 utilizes both of these concentrating concepts.

In a further embodiment of the invention, base charge 14 is in the form of shock tube 150 for detonation of a high explosive charge at the opposition end of the tube. A shock wave or detonation wave travels through the tube to the explosive. This tube includes a top portion 152 cut at an angle to provide a greater access to initiator 20. Inside passage 154 may have a high explosive coating 156 in accordance with somewhat standard practice so that the explosive wave can travel through the tube or form a progressing explosion along the inner surface of passage 154. Space 160 accepts the plasma from initiator 20 along axis x which coincides with the center axis of passage 154 of shock tube 150. Spacing material 162 holds shock tube 150 in place so that as the plasma issues from partition 52 the plasma can move through the shock tube. Material 162 is inert and allows expansion of the tube. The plasma initiates operation of the shock wave through the tube. Activation of the standard shock tube is equivalent to the detonation of the base charge 14. The shock tube is indicated to be a base charge 14*c*.

It is possible to provide a confined junction from a metal wire, as distinguished from the PN junction of an LED chip, so long as the wire can establish an electric arc which is sustainable in a confined area by a high voltage applied across the leads of the initiator for a time period necessary to build up the pressure and temperature within the confined space to create a plasma. The wire must establish the arc and allow the leads to feed energy into the arc until the plasma is created. Upon creation of the plasma, the thin wall provided in the confinement housing can no longer retain the pressure build up by the arc energy. The wall or partition ruptures in the controlled direction x for the purpose of initiating the base charge. This modified implementation of the present invention is illustrated in FIGS. 8 and 9 wherein initiator 200 includes an encapsulating housing of hard plastic or glass 202 for confining a junction in the form of a bridgewire 204 including an energetic metal. The wire will create an arc between leads 206, 208 and allow the arc to accumulate energy for the purposes of increasing the temperature and pressure within the confinement housing until such temperature and pressure is sufficiently high to create a plasma. Of course, the plasma can not be formed by the arc if there is a quenching action from the exterior of housing 202 or migration of material through the housing into the arc area. Back plate 210 is a force reactive plate to drive the plasma forward through rupture point, indentation or recess 212 formed as an inner flat circular wall 214 and an outer conical peripheral wall 216, as previously described. The preferred embodiment of the invention employs the PN junction of a standard LED device. A bridgewire of energetic material which is sufficiently ionized during creation of an arc may perform the function of the present invention, which function is the use of the arc energy to create a plasma within a confined space whereby the plasma erupts through the directional wall to collide against the based charge in the blasting cap. FIG. 10 is a similar modification of the present invention wherein initiator 220 includes a confinement housing 222 and has leads 224, 226. A fuse 230 of energetic metal is provided between the leads to create an electric arc within the confinement housing which arc is fed energy by the high voltage energy pulse until the pressure and temperature in the confinement housing is sufficient to create a plasma which ruptures through recess 232 having a lower flat wall 234 and a conical side wall 236.

Figure 11:
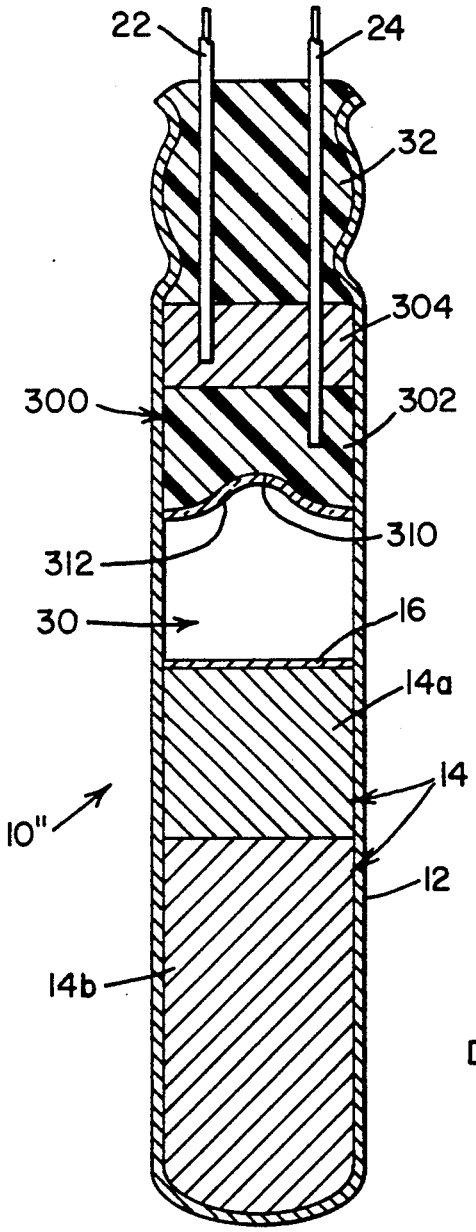
FIG. 11 is a cross sectional view of an electric blasting cap employing an initiator formed from a lithium/iodine battery.

In FIG. 11, blasting cap 10" includes components similar to those shown in FIG. 1 in which case the same numbers are employed. In this particular embodiment, the initiator 300 is a somewhat standard lithium/iodine battery wherein the reactive energetic material is a layer of lithium 302 and iodine layer 304. The material coacts with leads 22, 24 for creating an arc at the lithium layer 302. This arc is sustained by casing 12 until plasma is created and directed toward barrier 16. To direct the plasma, a shaped charge concept is employed wherein a semi-spherical recess 310 is employed. This recess is covered by glass layer 312 to confine the arc within the cartridge 12 above recess 310. The recess directs the plasma through cavity 30 which build up in pressure to assist in the ignition of the base charge.

Figure 12:
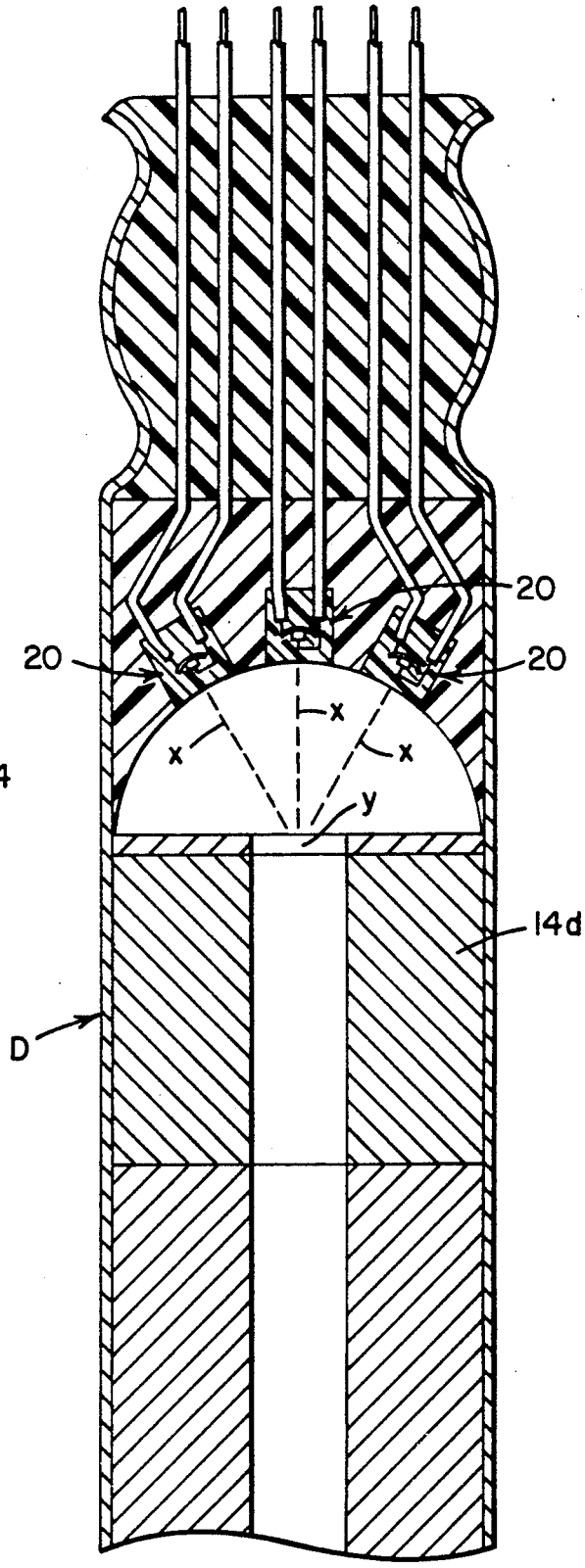
FIG. 12 is a partial cross sectional view showing the use of three of the improved initiators for detonating a single base charge of a blasting cap.

In FIG. 12, a large electric blasting cap D is illustrated wherein the base charge 14*d* is simultaneously ignited by three separate initiators 20 directing their individual plasma discharge along axes x toward concentration point y. Energy at this point ignites base charge as previously described. FIG. 13 is a similar schematic illustration, wherein blasting cap E has a single base charge 14*e* surrounded by four separate initiators 20. Plasma created by these initiators is directed along the individual selected direction or axes x to impinge upon the base charge 14*e*. As can be seen, two or more initiators can be employed in a blasting cap for the purposes of intensifying the amount of energy available for detonating the base charge. This is somewhat important in view of the fact that the standard LED units which are modified for the purposes of practicing the invention are relatively small in size and create a limited amount of Joules of energy. It is estimated there are approximately 20 millijoules created by the abrupt initiation and rupture of the commercially available LEDs modified to practice the present invention.

As previously described, a radial LED such as Panasonic P389 (LN2G) could also be employed in practicing the invention. This is schematically illustrated in FIGS. 14–16 wherein a standard LED 400 is provided. A portion of the cylindrical surface which emits light is ground off. This is indicated as area 402. The total area around the unit could be ground away so that the plasma is directed radially outwardly in all directions. In accordance with the illustrated embodiment, only a portion of the cylindrical surface is ground away to form a localized thin area for rupture. This rupture area controls the direction of the plasma as it is directed outwardly from the internal PN junction of the linear or radial LED unit 400. The selective ground portion 402 is in the side of the epoxy tube 404. Leads 410, 412 are connected to an internal PN junction as previously described. By using this alternative concept, a base charge 14*f* can be surrounded by a number of initiators 400 with the selectively ground area 402 facing inwardly and in a radial direction as shown in the arrows in FIG. 16. These initiators are mounted within an outer metal container 420 to define an annular space 422 surrounding the inner base charge 14*f*. When initiators 400 are detonated, plasma is directed by each initiator 400 directly against the base charge. Also, plasma is directed into chamber 422. This chamber increases in pressure and temperature to cause ignition of the base charge in conjunction with the direct impingement of the plasma from the individuals detonators. This description is submitted for the purposes of completing the disclosure of the present invention and the application of the invention to various embodiments and modes of operation.

In FIG. 17, a blasting machine BM is provided with an initial voltage of 1–4 K volts and an internal capacitance of 10–20 microfarads. With 1000 volts, seven caps 10 can be detonated with 10 foot lines between the caps. The voltage pulse F created by blasting machine BM is shown schematically in FIG. 18. The pulse provides a rapid increase in voltage and a gradual decrease. In the illustrated embodiment, as used in the present invention, pulse F has an initial voltage that increases to approximately 2,000 volts within about 1.0 microsecond. The voltage then retains a relatively high level based upon the amount of capacitance within the blasting machine BM so that the voltage is at approximately 50% of the initial value after 10.0 microseconds. This substance introduces a substantial amount of current to create energy in the arc. The arc is immediately created upon application of the 2000 volts across the leads 22, 24 of initiator 20. FIG. 18A illustrates a pulse F1 with initial voltage of 2000 volts. Pulse F1 is maintained with 10 microfarads. In this example, the voltage remains fairly high; however, the discharge is at a greater rate than shown in FIG. 18A since the initial voltage is at 2,000 volts. Pulse F2 in FIG. 18B has an initial voltage of 600 volts. This example uses a blasting machine with about 100 microfarads. As can be seen, pulse F2 retains the voltage for a prolonged period of time based upon the high capacitance of the blasting machine. Pulses F1 and F2 both pump substantial energy into the arc formed in the junction of the initiator. The preferred embodiment employs the pulse similar to F1. This is illustrated as pulse F in FIG. 18.

The initial voltage of pulse F, F1 or F2 is combined with the capacitance to give the high energy under the voltage curve of the pulse. With voltages over about 1000 volts the capacitance is in the range of 10–30 mfd. This gives a fast plasma with high impact energy. When the voltage is lower, i.e. 500–700 volts the capacitance is increased to a level such as 50–150 mfd to give a slower acting plasma.

Two different energy delivery circuits were used for the tests of the blasting machines. One utilized a silicon controlled rectifier (SCR) as the switching means and up to 1000 volts capacitor charge. The second circuit is the DuPont SS1100 Blasting Machine which utilizes a trigger tube as the switching means and a fixed 2000 volt capacitor charge. The delivery of initiators 20 was several times faster with the trigger tube circuit. The tests were performed with no inductance or resistance in series with the SCR — only that amount normally present in the circuit layout.

The results of the test were that 600 volts and 30 mfd exploded an initiator 20 with up to 600 feet of feed line. A pulse with 2000 volts and 12 mfd exploded 10 glass initiators with up to 30 feet of lead line. A pulse of 2000 volts and 12 mfd exploded 3 plastic initiators 20 with up to 150 feet of lead line. The energy must be delivered to the initiator very rapidly, within less than bout 1.0 microsecond. The preferred blasting machine is the trigger tube unit. A very fast SCR machine may be used if the dv/dt is high enough to give the maximum voltage is less than 1.0 microsecond.

Having thus defined the invention, the following is claimed:

1. In an electric detonator including a base charge of high explosive material, an initiator means for creating an abrupt eruption in response to application of a selected voltage across said initiator means, and means for detonating said base charge upon creation of said abrupt eruption of said initiator means, the improvement comprising: said initiator means including a junction of energetic material encapsulated in a plastic or glass confinement housing having a directional controlling partition means facing in a selected direction, said partition means having an effective spacing from said junction substantially less than the remainder of said confinement housing whereby application of a voltage pulse with a starting voltage of over about 500 volts and a sustained voltage causes said junction to form an electric arc to create a plasma by a confined, high temperature high pressure exothermic reaction, said effective spacing of said partition means being thick enough to confine said exothermic reactance until creation of said plasma and thin enough to allow said plasma to rupture said control partition means and penetrate through said partition means a given distance in said selected direction and means for fixing said base charge in said selected direction and spaced from said partition means a distance less than said given distance.

2. The improvement as defined in claim 1 wherein said junction contains energetic metals.

3. The improvement as defined in claim 2 wherein said metals are selected from the class comprising gallium arsenide, aluminum gallium arsenide, gallium phosphide, lithium/iodine, a gallium component with gold, other compositions of gallium and other III–V Group compounds.

4. The improvement as defined in claim i wherein said junction is a PN junction.

5. The improvement as defined in claim 1 wherein said junction includes a force reactive, back plate encapsulated in said plastic confinement housing and located on the side of said junction opposite to said selected direction.

6. The improvement as defined in claim 5 wherein said force reactive back plate is separate from said junction.

7. The improvement as defined in claim 5 wherein said junction is a PN junction and said reactive back plate is an electrode of said junction.

8. The improvement as defined in claim 7 wherein said back plate is concaved and faces in said selected direction.

9. The improvement as defined in claim 8 wherein a second electrode of said junction is formed from gold and located between said back plate and said control partition.

10. The improvement as defined in claim 5 wherein a second electrode of said junction is formed from gold and located between said back plate and said control partition.

11. The improvement as defined in claim 5 wherein said back plate is a means for focusing said arc created plasma in said selected direction.

12. The improvement as defined in claim 6 wherein said back plate is a means for focusing said arc created plasma in said selected direction.

13. The improvement as defined in claim 1 wherein said partition means is defined by a shaped recess in said plastic confinement housing.

14. The improvement as defined in claim 13 wherein said recess includes an innermost generally flat surface.

15. The improvement as defined in claim 14 wherein said recess is generally circular and has a generally conical outer periphery.

16. The improvement as defined in claim 4 wherein said partition means is defined by a shaped recess in said plastic confinement housing.

17. The improvement as defined in claim 16 wherein said recess includes an innermost generally flat surface.

18. The improvement as defined in claim 17 wherein said recess is generally circular and has a generally conical outer periphery.

19. The improvement as defined in claim 5 wherein said partition means is defined by a shaped recess in said plastic confinement housing.

20. The improvement as defined in claim 19 wherein said partition means includes means for forming a fracture point directly opposite to said junction.

21. The improvement as defined in claim 13 wherein said partition means includes means for forming a fracture point directly opposite to said junction.

22. The improvement as defined in claim 5 wherein said partition means includes means for forming a fracture point directly opposite to said junction.

23. The improvement as defined in claim 1 wherein said partition means includes means for forming a fracture point directly opposite to said junction.

24. The improvement as defined in claim 1 including a safety barrier means on said base change and spaced from said partition means a selected standoff distance.

25. The improvement as defined in claim 24 wherein said barrier means is a layer of copper.

26. The improvement as defined in claim 13 including a safety barrier means on said base change and spaced from said partition means a selected standoff distance.

27. The improvement as defined in claim 26 wherein said barrier means is a layer of copper.

28. The improvement as defined in claim 5 including a safety barrier means on said base change and spaced from said partition means a selected standoff distance.

29. The improvement as defined in claim 28 wherein said barrier means is a layer of copper.

30. The improvement as defined in claim 13 wherein said junction includes first and second electrodes and said electrodes are both aligned with said recess.

31. The improvement as defined in claim 30 wherein said recess is generally circular and has a generally conical outer periphery.

32. The improvement as defined in claim 31 wherein said partition means includes means for forming a fracture point directly opposite to said junction.

33. The improvement as defined in claim 30 wherein said partition means includes means for forming a fracture point directly opposite to said junction.

34. The improvement as defined in claim 1 wherein said plastic is a clear epoxy plastic.

35. The improvement as defined in claim 5 wherein said plastic is a clear epoxy plastic.

36. The improvement as defined in claim 13 wherein said plastic is a clear epoxy plastic.

37. The improvement as defined in claim 1 wherein said base charge is lead azide.

38. The improvement as defined in claim 5 wherein said base charge is lead azide.

39. The improvement as defined in claim 13 wherein said junction is a PN junction.

40. The improvement as defined in claim 1 wherein said junction includes a gold electrode which vaporizes during creation of said plasma.

41. The improvement as defined in claim 5 wherein said junction includes a gold electrode which vaporizes during creation of said plasma.

42. The improvement as defined in claim 13 wherein said junction includes a gold electrode which vaporizes during creation of said plasma.

43. The improvement as defined in claim 1 wherein said base charge is a hollow tube containing high explosive powder on the inside surface thereof and having an opened end facing said partition means.

44. The improvement as defined in claim 43 wherein said open end is cut at an angle to the axis of said tube.

45. The improvement as defined in claim 1 wherein said junction is the PN junction of an epoxy packaged LED device with said partition means being a reduced wall at the light exposure side of said packaged LED device.

46. The improvement as defined in claim 45 wherein said effective spacing is greater than about 1/32 inch.

47. The improvement as defined in claim 45 wherein said effective spacing is generally about 1/16 inch.

48. The improvement as defined in claim 45 wherein said effective spacing is in the range of about 1/32–3/32.

49. The improvement as defined in claim 1 wherein said effective spacing is greater than about 1/32 inch.

50. The improvement as defined in claim 1 wherein said effective spacing is generally about 1/16 inch.

51. The improvement as defined in claim 1 wherein said effective spacing is in the range of about 1/32–3/32.

52. The improvement as defined in claim 5 wherein said effective spacing is greater than about 1/32 inch.

53. The improvement as defined in claim 5 wherein said effective spacing is generally about 1/16 inch.

54. The improvement as defined in claim 5 wherein said effective spacing is in the range of about 1/32–3/32.

55. The improvement as defined in claim 1 wherein said voltage pulse is at less than 50% of voltage by about 10 s.

56. The improvement as defined in claim 55 wherein said output voltage is in the range of 1–4 K volts.

57. The improvement as defined in claim 55 wherein the capacitance forming said voltage pulse is about 0.1 microfarads up to about 10–20 microfarads.

58. The improvement as defined in claim 1 wherein said output voltage is in the range of 1–4 K volts.

59. The improvement as defined in claim 1 wherein the capacitance forming said voltage pulse is about 0.1 microfarads up to about 10–30 microfarads for an initial voltage of over about 1000 volts and in the range of about 10–30 microfarads for initial voltages between 500–1000 volts.

60. A method of detonating the base charge in an electric blasting cap, said method comprising the steps of:

(a) creating an electric arc creating element;

(b) encapsulating said element in a plastic or glass confinement housing;

(c) modifying said plastic housing at one surface to define a rupture point;

(d) applying to said element a voltage pulse having an initial value of 1–4 K volts created within less than about 1.0 s with a sustained voltage of over 50% of said initial value for at least about 5–10 s; and, (e) directing the electric arc issuing from said rupture point against said base charge.

61. A method of making an initiator for an electric blasting cap, said method comprising the steps of:

(a) providing an LED having two leads, encapsulated in an epoxy housing, PN junction and a light exposure top on said epoxy or glass housing;

(b) removing said exposure top to create a thin wall over said PN juncture with a thickness of at least about 1/32 inch.

62. The method as defined in claim 61 wherein said thickness is generally about 1/16 inch.

63. The method as defined in claim 61 wherein said thickness is in the general range of about 1/32–3/32.

* * * * *

UNITED STATES PATENT AND TRADEMARK OFFICE

CERTIFICATE OF CORRECTION

PATENT NO. : 5,052,301

DATED : October 1, 1991

INVENTOR(S) : Richard E. Walker

It is certified that error appears in the above-identified patent and that said Letters Patent is hereby corrected as shown below:

Column 17, claim 48, line 30, after "1/32-3/32" insert -- inch --. Claim 51, line 36, after "1/32-3/32" insert -- inch --. Claim 54, line 42, after "1/32-3/32" insert -- inch --. Claim 63, line 42, after "1/32-3/32" insert --inch--.

Signed and Sealed this

Tenth Day of May, 1994

*Attest:*

*Attesting Officer*

Bruce Lehman

BRUCE LEHMAN

*Commissioner of Patents and Trademarks*